United States Patent [19]

Schieman

[11] 4,164,475

[45] Aug. 14, 1979

[54] MULTI-GRADE 80W-140 GEAR OIL

[75] Inventor: Richard D. Schieman, Avon Lake, Ohio

[73] Assignee: The Standard Oil Company, Cleveland, Ohio

[21] Appl. No.: 576,007

[22] Filed: May 9, 1975

[51] Int. Cl.[2] ..... C10M 1/32

[52] U.S. Cl. ..... 252/46.7; 208/19; 252/32.7 E; 252/51.5 A

[58] Field of Search ..... 252/32.7 E, 46.7, 51.5 A; 208/19

[56] References Cited

U.S. PATENT DOCUMENTS

| | | | |
|---|---|---|---|
| 3,236,771 | 2/1966 | Matson | 252/32.7 E |
| 3,238,130 | 3/1966 | Matson | 252/32.7 E |
| 3,250,711 | 5/1966 | Early | 252/37.2 |
| 3,267,033 | 8/1966 | Allen | 252/32.7 E |
| 3,451,930 | 6/1969 | Mead | 252/32.7 E |
| 3,493,505 | 2/1970 | Ries et al. | 208/19 X |
| 3,796,662 | 3/1974 | Lyle et al. | 252/32.7 E |

FOREIGN PATENT DOCUMENTS

| | | | |
|---|---|---|---|
| 1594329 | 12/1971 | Fed. Rep. of Germany | 252/32.7 E |

*Primary Examiner*—Delbert E. Gantz
*Assistant Examiner*—Andrew Metz
*Attorney, Agent, or Firm*—John F. Jones; Sherman J. Kemmer

[57] ABSTRACT

A multi-grade 80W–140 gear oil is described which is composed of certain mineral-oil stocks, a wear additive, a V.I. improver, a dispersant polymer and optionally a seal-swell agent.

1 Claim, No Drawings

MULTI-GRADE 80W-140 GEAR OIL

The present invention relates to a novel gear oil which is useful over a wide variation in temperature, and more particularly pertains to a multi-grade 80W-140 gear-oil composition.

The gear-oil composition of this invention was formulated to meet the minimum 210° F. viscosity of 25 centistokes required for an SAE 140 oil and at the same time to meet the −15° F. maximum viscosity of 150,000 centipoises (Brookfield) required for 80W by SAE J-306a and meeting the −30° F. channel point required for SAE 80 by MIL-L-2105B. Base-stock viscosity should be as high as possible to assure best performance. Oil stocks derived from mid-continent crude oil through distillation into boiling ranges of about 100° F., furfural extraction to 95 V.I., and MEK-toluene solvent dewaxing to 0° F. pour point have been found to be advantageous in meeting the viscometric requirements. A wear additive containing sulfur and phosphorous is usually used for imparting improved extreme pressure, anti-wear, anti-rust and oxidation inhibition to the gear oil. The V.I. improver is an alkyl methacrylate copolymer of relatively specific molecular weight range.

A key to meeting the low-temperature flow requirements without having to alter base-stock composition materially was the discovery of the unexpected beneficial effect of including small amounts (about 0.1 to 1.5%) of dispersant polymer which is preferably an alkyl methacrylate copolymer which has been grafted with a dialkyl amino methacrylate monomer which appears to function as a glass-transition modifier.

A seal-swell agent, which may be a dialkyl ester of phthalic acid, other diesters or an aromatic hydrocarbon mixture, is optionally included in the gear oil of my invention.

The 80W-140 formula of this invention has been extensively tested as a differential lubricant in auto and truck fleets where it has matched or exceeded performance of single-grade SAE 90 oils and SAE 140 oils. The gear oil of this invention has given outstanding performance as a lubricant for worm gears in industrial machines. In the tests with the gear oil of this invention, the oil stayed in grade after prolonged testing in the Vickers pump (ASTM 2882), in the SAE L-37 test, and in the worm gears of industrial machinery.

The composition of the 80W-140 gear oil of my invention falls within the following ranges of ingredients on a volume-percentage basis:

| Ingredients | Volume % |
|---|---|
| petroleum-oil stock | |
| 5.0 centistokes at 210° F. | 23–20 |
| 14.0 centistokes at 210° F. | 25–24 |
| 25.0 centistokes at 210° F. | 26–30 |
| wear additive | 5–6 |
| V.I. improver | 16.6–18.6 |
| dispersant polymer | 0.1–1.5 |
| seal-swell agent | 0–2.7 |

The following 80W-140 gear-oil formulation was found to be especially effective:

| Ingredients | Volume % |
|---|---|
| 5.0 centistokes at 210° F. oil | 23.3 |
| 14.0 centistokes at 210° F. oil | 25.2 |

-continued

| Ingredients | Volume % |
|---|---|
| 25.0 centistokes at 210° F. oil | 25.7 |
| sulfur-phosphorous wear additive | 5.5 |
| V.I. improver (copolymer of butyl methacrylate and lower level of lauryl methacrylate, 450,000 weight average molecular weight) | 16.6 |
| dispersant polymer (copolymer of lauryl methacrylate and butyl methacrylate grafted with dimethyl amino ethyl methacrylate) | 1.0 |
| seal-swell agent (aromatic hydrocarbon mixture, B.P. 650°–725° F.) | 2.7 |

This gear-oil formulation was found to have a viscosity at −15° F. of 138,000 centipoises, a viscosity at 210° F. of 29.04 centistokes and a channel point of −45° F. The base-oil mixture alone for the above formulation had a viscosity at 210° F. of 11.86 centistokes.

The above gear-oil formulation was tested in the differential gear of a passenger automobile and, at the same time, an SAE 90 gear oil was tested in a second automobile and an SAE 140 gear oil was tested in a third automobile. The three test automobiles were driven 40,000 miles, the gear oils were removed and then analyzed for iron by x-ray diffraction analysis. The 80W-140 oil of this invention was found to contain 370 ppm of iron, the SAE 90 gear oil contained 1400 ppm of iron and the SAE 140 gear oil contained 1200 ppm of iron.

An industrial worm-gear test in a hot-wire drawing machine over a period of 10 weeks using the 80W-140 gear-oil formulation of this invention showed that the gear oil suffered relatively no degradation, as demonstrated by the following viscosity and acid numbers:

| Weeks of Use | Viscosity at 210° F. | Acid Number |
|---|---|---|
| 0 | 28.4 | 2.99 |
| 2 | 27.8 | 3.22 |
| 4 | 27.7 | 4.75 |
| 8 | 25.2 | 3.69 |
| 10 | 25.9 | 3.70 |

The low-temperature viscosity for the gear oil of this invention, rather than being as expected by extrapolation from 210° F. and 100° F. viscosities of the oil, meets the measured −15° F. viscosity required by the latest SAE recommended practice (J-306a). It should be noted that while there are other multi-grade gear oils commercially available, none of them meet the 80W requirement of SAE J-306a.

The gear oil of this invention exhibits wear control equal to or greater than that of the single-grade 90 or 140 gear oils. Most technology available at the present time indicates that multi-grade gear oils in the 80W range cannot accommodate base oils having viscosities much in excess of 6 centistokes at 210° F. Much of this control is due to the high viscosity of the base oil as well as the contribution of the V.I. improvers. Unexpectedly, the viscosity of the base oil employed in the multi-grade gear oil of the present invention is in the range of 11 to 13 centistokes at 210° F.

The gear oil of this invention has the sanction of the U.S. Military Board of Review, and this is the first multi-grade gear oil to have received this distinction.

Field tests of the gear oil of this invention in trucks, passenger cars, and a variety of industrial equipment indicate that this oil is not only multi-grade but also is multi-functional.

The multi-grade gear oil of this invention meets the ASTM D-892 foam test and has a Timken OK load of 55 pounds (50 pounds with 0.25% and 0.5% of water added and 45 pounds with 0.75% of water added).

I claim:

1. In a multi-grade gear oil composition comprising a major proportion of mineral lubricating oil, 5–6 volume percent sulfur- and phosphorous-containing wear additive, 16.6–18.6 volume percent V.I. improver, and 0–2.7 volume percent seal-swell agent, the improvement comprising using as the oil a petroleum-oil stock composed of 20–23 volume percent of a 5.0 centistokes at 210° F. oil, 24–25 volume percent 14.0 centistokes at 210° F. oil, and 26–30 volume percent 25.0 centistokes at 210° F. oil, and from 0.1 to 1.5 volume percent of a dispersant polymer which is an alkyl methacrylate copolymer which has been grafted with a dialkyl amino methacrylate monomer.

* * * * *